US008162315B2

(12) United States Patent
Baba

(10) Patent No.: US 8,162,315 B2
(45) Date of Patent: Apr. 24, 2012

(54) PEELING DEVICE, FIXING UNIT, AND IMAGE FORMING APPARATUS

(75) Inventor: Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 356 days.

(21) Appl. No.: 12/557,100

(22) Filed: Sep. 10, 2009

(65) Prior Publication Data

US 2010/0171260 A1 Jul. 8, 2010

(30) Foreign Application Priority Data

Jan. 7, 2009 (JP) ..... P2009-001668

(51) Int. Cl.
*G03G 15/20* (2006.01)

(52) U.S. Cl. ..... 271/312; 271/900; 399/323

(58) Field of Classification Search ..... 271/307, 271/309, 312, 900; 399/323, 398, 399
See application file for complete search history.

(56) References Cited

U.S. PATENT DOCUMENTS

| | | | | |
|---|---|---|---|---|
| 5,406,363 | A * | 4/1995 | Siegel et al. | 399/323 |
| 2008/0080909 | A1* | 4/2008 | Yamada | 399/323 |
| 2011/0091249 | A1* | 4/2011 | Murakami et al. | 399/323 |
| 2011/0217091 | A1* | 9/2011 | Hirose et al. | 399/323 |
| 2011/0222921 | A1* | 9/2011 | Murakami et al. | 399/323 |

FOREIGN PATENT DOCUMENTS

| | | | |
|---|---|---|---|
| JP | 54115133 | A * | 9/1979 |
| JP | 03182785 | A * | 8/1991 |
| JP | 08-137322 | | 5/1996 |
| JP | 2000-089603 | | 3/2000 |
| JP | 2002-311740 | | 10/2002 |
| JP | 2004-212954 | | 7/2004 |
| JP | 2005-049647 | | 2/2005 |
| JP | 2005-128333 | | 5/2005 |
| JP | 2008-083475 | | 4/2008 |

* cited by examiner

*Primary Examiner* — Jeremy R Severson
(74) *Attorney, Agent, or Firm* — Morgan, Lewis & Bockius LLP

(57) ABSTRACT

A peeling device is provided and includes: a rotating body that conveys a recording material; a peeling member capable of changing from a first state in which the peeling member is away from the rotating body to a second state in which the peeling member is closer to the rotating body than the peeling member in the first state is, the peeling member in the second state peeling off the recording material from the rotating body; and a gas spraying unit that sprays a gas to the peeling member to bring the peeling member from the first state to the second state.

10 Claims, 9 Drawing Sheets

PEELING DEVICE, FIXING UNIT, AND IMAGE FORMING APPARATUS

CROSS-REFERENCE TO RELATED APPLICATION

This application is based on and claims priority under 35 USC §119 from Japanese Patent Application No. 2009-001668, filed Jan. 7, 2009.

BACKGROUND

The present invention relates to a peeling device, a fixing unit, and an image forming apparatus.

SUMMARY

According to an aspect of the invention, there is provided a peeling device including:

a rotating body that conveys a recording material;

a peeling member capable of changing from a first state in which the peeling member is away from the rotating body to a second state in which the peeling member is closer to the rotating body than the peeling member in the first state is, the peeling member in the second state peeling off the recording material from the rotating body; and a gas spraying unit that sprays a gas to the peeling member to bring the peeling member from the first state to the second state.

DETAILED DESCRIPTION

(1) First Embodiment (Configuration)

Figure 1:
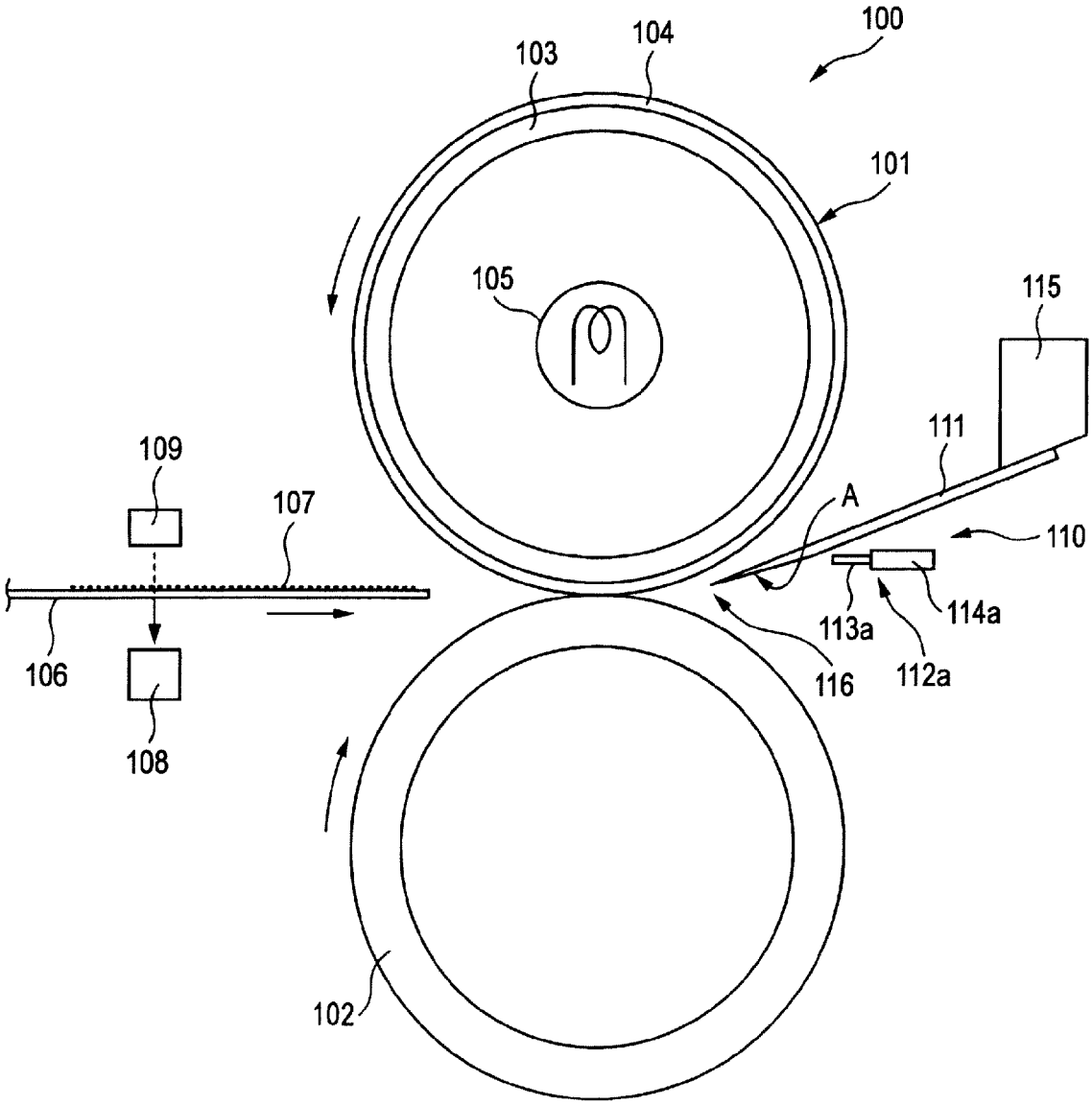
FIG. 1 is a conceptual diagram showing a fixing unit according to an exemplary embodiment of the invention.

FIG. 1 is a conceptual diagram showing a fixing unit of an exemplary embodiment of the invention. FIG. 1 shows a fixing unit 100. The fixing unit 100 has a heating roller 101 and an opposing roller 102. The heating roller 101 is an embodiment of a rotating body, in which a surface layer 104 made of a resin material is provided on a surface of a base material 103 made of a cylindrical metal material. A heater 105 acting as an embodiment of a heating unit is disposed inside of the base material 103. The heating roller 101 is rotated in a counterclockwise direction in the drawing by means of a drive mechanism which is omitted from the drawings.

The opposing roller 102 has a structure built from a metal cylinder, and rotates in a clockwise direction of FIG. 1 by dint of driving force resultant from rotation of the heating roller 101 with a sheet (an embodiment of a recording material) conveyed from left to right in FIG. 1 nipped between the opposing roller 102 and the heating roller 101.

Reference numeral 106 designates a sheet that is an embodiment of a recording material. In FIG. 1, a toner image 107 is formed on a sheet 106. The toner image 107 is formed by an image forming unit that is not drawn in FIG. 1. In FIG. 1, a sheet detection sensor 108 is provided for detecting arrival of the sheet 106. The sheet detection sensor 108 is a light-receiving sensor, and detects arrival of the sheet 106 upon interruption of an optical axis linked to a light-emitting element 109.

Figure 2:
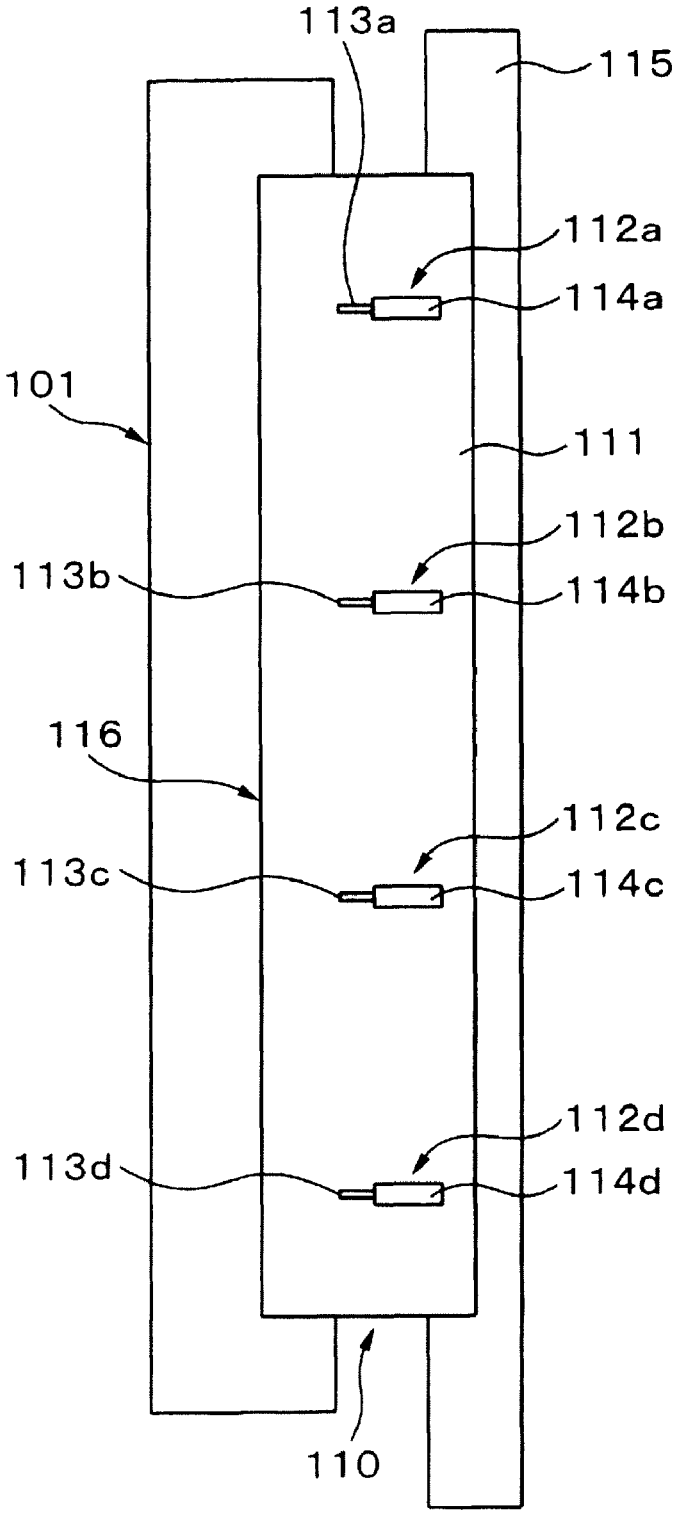
FIG. 2 is a bottom view showing a peeling device according to an exemplary embodiment of the invention.

FIG. 1 shows a peeling device 110 that is an embodiment of the invention. FIG. 2 shows the peeling device 110 when viewed from below in FIG. 1. The peeling device 110 has a peeling plate 111 that is an embodiment of a peeling member and gas spraying devices 112*a* to 112*d* that each is an embodiment of the gas spraying unit. The peeling plate 111 is made of plate-shaped resin plate that is wide in an axial direction of the heating roller 101. The peeling plate 111 is fastened to a support member 115 fixed to a member that supports the fixing unit 100, and extends from the support member toward a location where the heating roller 101 contacts the opposing roller 102. The peeling plate 111 is made of a material and in a configuration such that, when an edge (hereinafter called a "front edge") of the peeling plate achieved in an upstream direction designated by reference numeral 116 is pressed toward the heating roller 101, the edge becomes elastically deformed while a portion of the peeling plate 111 fixed to the support member 115 is taken as a fulcrum, whereupon the front edge 116 comes into contact with the heating roller 101.

The gas spraying devices 112*a* to 112*d* for spraying compressed air to a surface A are disposed on the same side as that of the surface A that is opposite to a surface of the peeling plate 111 opposing the heating roller 101. The gas spraying device 112*a* has a nozzle 113*a* and an electromagnetic valve 114*a*; the gas spraying device 112*b* has a nozzle 113*b* and an electromagnetic valve 114*b*; the gas spraying device 112*c* has a nozzle 113*c* and an electromagnetic valve 114*c*; and the gas spraying device 112*d* has a nozzle 113*d* and an electromagnetic valve 114*d*.

The nozzles 113*a* to 113*d* are cylindrical, and compressed air is squired in a left direction of the drawing from circular orifices provided at respective extremities of the nozzles. The electromagnetic valves 114*a* to 114*d* are supplied with compressed air from a compressed gas supply system omitted from FIG. 1. The electromagnetic valves 114*a* to 114*d* control timing at which compressed air is supplied to the nozzles 113*a* to 113*d*.

(Configuration of the Control System and Configuration of the Compressed Air Supply System)

Figure 3:
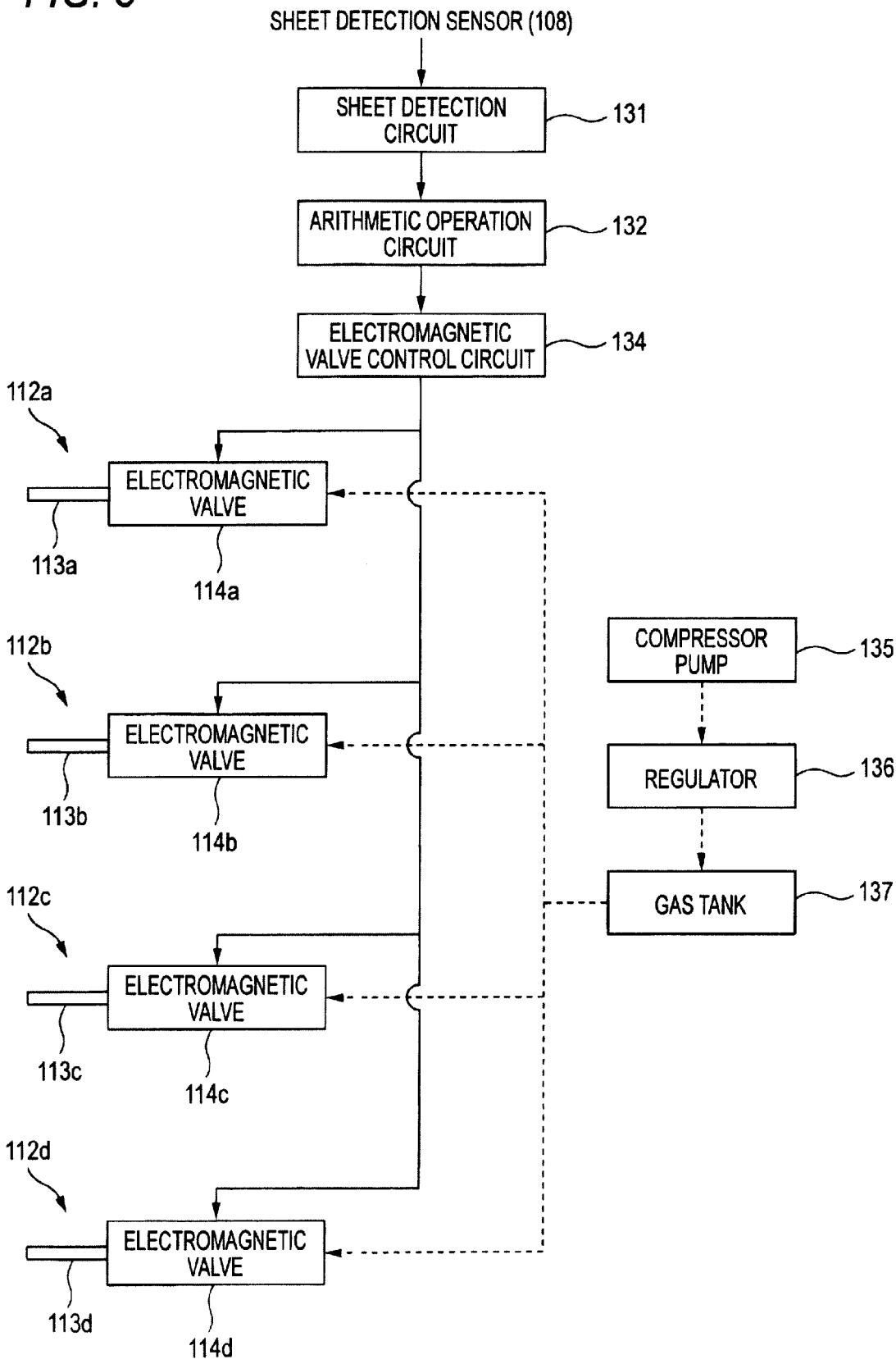
FIG. 3 is a block diagram showing a control system of a peeling device according to an exemplary embodiment of the invention.

FIG. 3 is a block diagram showing a control system and a compressed gas supply system of the fixing unit shown in FIG. 1. Since the fixing unit is identical with an ordinary fixing unit in terms of a configuration for controlling fixing operation, descriptions of the fixing unit are omitted.

In FIG. 3 a sheet detection circuit 131 generates a signal showing presence and absence of a sheet in accordance with an output from a sheet detection sensor 108 shown in FIG. 1. An arithmetic operation circuit 132 computes a time (a position on a time axis) at which a front edge of the sheet 106 approaches closest to a front edge 116 of the peeling plate 111 from an output from the sheet detection circuit 131; namely, information about the position of the sheet detected by the sheet detection sensor 108.

An electromagnetic valve control circuit 134 controls timing at which the electromagnetic valve 114 is opened and closed, from a result of computation performed by the arithmetic operation circuit 132. In the embodiment, the electromagnetic valve control circuit 134 performs control operation for opening the electromagnetic valves 114*a* to 114*d* at a point in time 20 msec before the time when the front edge of the sheet 106 approaches closest to the front edge 116 of the peeling plate 111; and maintaining the open state for 40 to 100 msec and subsequently closing the electromagnetic valves 114*a* to 114*d*.

A compressor pump 135 is a pump that compresses air to pressure which is higher than ordinary pressure. A regulator 136 stabilizes the compressed air pressure from the compressor pump 135. The air (compressed air) compressed by the compressor pump 135 is stored in an air tank 137. The compressed air stored in the air tank 137 is squirted toward the surface A of the peeling plate 111 from the nozzles 113*a* to 113*d* by way of the electromagnetic valves 114*a* to 114*d*.

In the embodiment, settings are made, as calculated values disregarding a loss, in such a way that compressed air is squirted at a flow rate of about 600 m/sec from the nozzles 113*a* to 113*d*. When compared with compressed air generated under a method for storing in a tank air whose pressure is made higher than ordinary pressure, air flow generated by use of a fan has been assumed to be insufficient for operation to be described later. Further, a gas to be used can also be a nitrogen gas, or the like, rather than air.

(Example of Operation)

FIG. 1 shows the general structure and provides descriptions of an operation of the fixing unit 100 whose control system is shown in FIG. 3. When the sheet 106 with the toner image 107 formed thereon approaches the heating roller 101 and reaches an imaginary line (an optical axis) between the sheet detection sensor 108 and the light-emitting element 109, an output from the sheet detection sensor 108 changes. The sheet detection circuit 131 detects the change and outputs a detection signal to the arithmetic operation circuit 132. The arithmetic operation circuit 132 received the detection signal calculates a time at which the leading edge of the sheet 106 will arrive at the front edge 116 of the peeling plate 111.

On the basis of a computation result, the electromagnetic valve control circuit 134 performs control operation for opening the electromagnetic valves 114*a* to 114*d* at a point in time 20 msec before the time when the front edge of the sheet 106 comes closest to the front edge 116 of the peeling plate 111 and holding the open state for 40 to 100 msec and subsequently closing the electromagnetic valves 114*a* to 114*d*. At this time, the compressed air is squirted from the electromagnetic valves 114*a* to 114*d* in a pulsing manner at a time interval of 40 to 100 msec.

The control parameters are determined so as to fulfill conditions under which the nozzle 113*a* squirts a compressed gas before the front edge of the sheet 106 arrives at the front edge 116 of the peeling plate 111 and under which, after the front edge of the sheet 106 has passed by the front edge 116 of the peeling plate 111, a squirt of the compressed air from the nozzle 113*a* is completed.

Figure 4A:
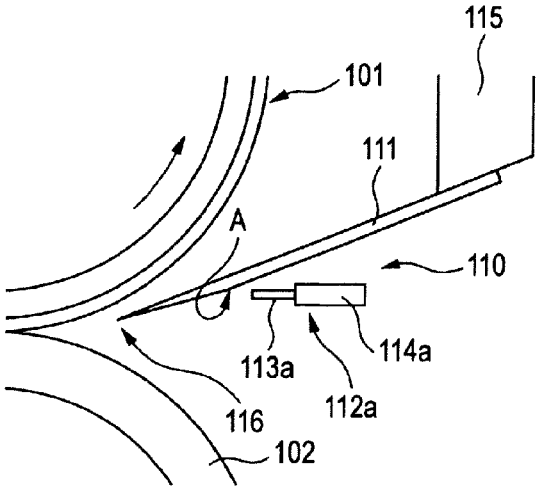
FIGS. 4A to 4D are phase diagrams showing a positional relationship between a peeling plate and a sheet according to an exemplary embodiment of the invention.

FIGS. 4A to 4D are phase diagrams showing a positional relationship between the peeling plate 111 and the sheet 106. FIG. 4A shows a state in which the front edge of the sheet 106 (a front edge achieved in the traveling direction) approaches closest to the front edge 116 of the peeling plate 111 after elapse of 30 msec. The position of the sheet 106 achieved at this time varies according to the conveyance speed of the sheet; however, in the present embodiment, the sheet has not yet reached a position that can be illustrated. In a state shown in FIG. 4A, the peeling plate 111 does not remain in contact with the heating roller 101, and the front edge 116 of the peeling plate 111 is spaced apart from the heating roller 101. The state shown in FIG. 4A is an example of the first state.

Figure 4B:
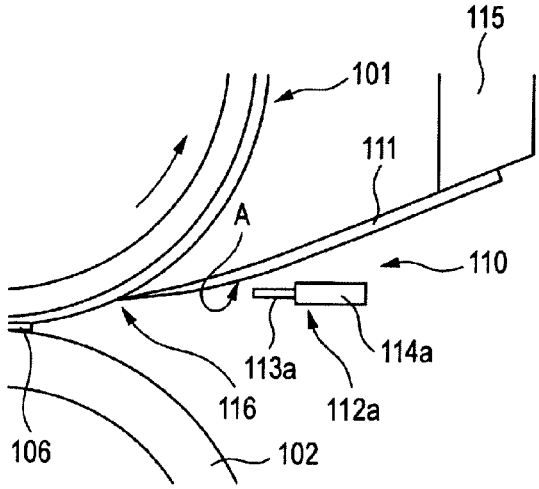

FIG. 4B shows a state in which the front edge of the sheet 106 approaches closest to the front edge 116 of the peeling plate 111 after elapse of 20 msec. The electromagnetic valve 114*a* is opened at this timing, and the nozzle 113*a* squirts compressed air. Although unillustrated in FIGS. 4A to 4D, the other electromagnetic valves and the other nozzles also perform similar operations.

When the nozzle 113*a* squirts compressed air, the flow of the thus-squirted air collides against the surface A of the peeling plate 111, whereupon the peeling plate 111 becomes elastically deformed in such a way that the edge 116 of the peeling plate 111 moves toward the heating roller 101. FIG. 4B shows a deformed state of the peeling plate 111. In a period during which a squirt of compressed air from the nozzle 113*a* continues, the front edge 116 is pushed against the heating roller 101 by pressure of the compressed air, so that the peeling plate 111 holds a state shown in FIG. 4B. The state shown in FIG. 4B is an example of the second state. In the embodiment, in the state shown in FIG. 4A that is an example of the first state, the peeling plate 111 is spaced apart from the heating roller 101 and is not in contact with the heating roller 101. When the state shown in FIG. 4B that is an example of the second state is achieved, the front edge 116 of the peeling plate 111 approaches the heating roller 101, and the peeling plate 111 comes into contact with the heating roller 101.

In the meantime, the sheet 106 undergoes heat from the heating roller 101 and pressurization as a result of being nipped between the heating roller 101 and the opposing roller 102. Toner forming the toner image 107 becomes fused by heating and pressurizing actions, whereupon the toner image is fixed on the sheet 106. At this time, when the toner image is a color image or a high pixel density image (e.g., an image, such as a photographed landscape), a phenomenon of an image-generated surface of the sheet 106 affixing to the heating roller 101 arises as illustrated.

Figure 4C:
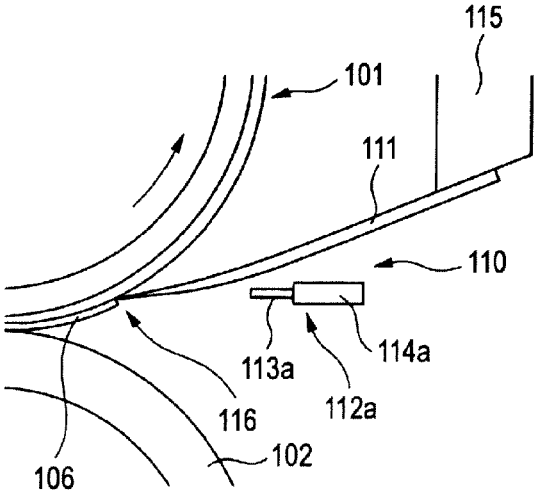
Figure 4D:
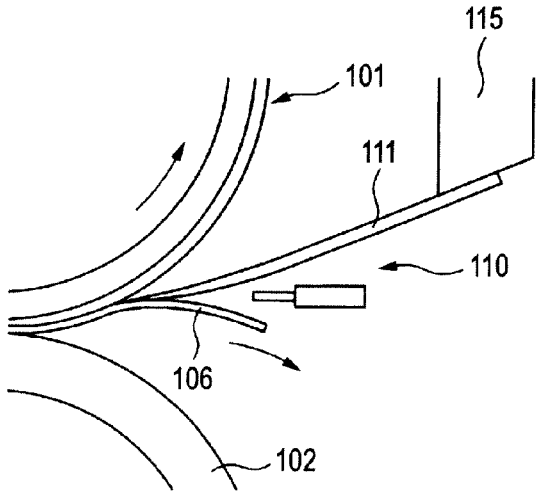
Figure 5A:
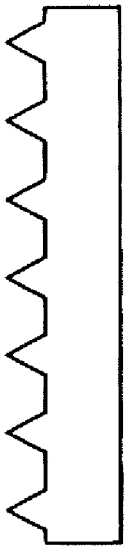
FIGS. 5A to 5D are top views showing shapes of a peeling plate according to an exemplary embodiment of the invention.
Figure 5B:
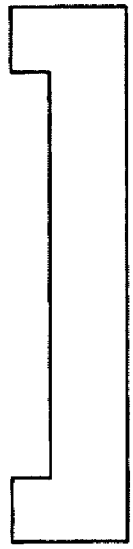
Figure 5C:
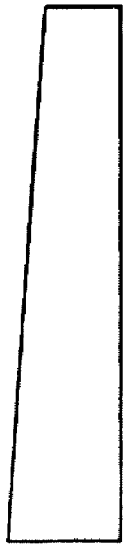
Figure 5D:
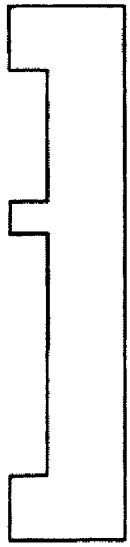

Descriptions are hereunder provided on the premise that the sheet 106 remains in close contact with and affixed to the heating roller 101. In the present embodiment, before arrival of the sheet 106 at the front edge 116 of the peeling plate 111, the peeling plate 111 is pressed toward the heating roller 101 by compressed air as shown in FIG. 4B, so that the front edge 116 remains in contact with the heating roller 101. Therefore, as shown in FIGS. 4C and 4D, the peeling plate 111 pushes its way between the sheet 106 and the heating roller 101. The sheet 106 affixed to the heating roller 101 is peeled off from the heating roller 101 by the peeling plate 111 in association with rotation of the heating roller 101.

When the heating roller 101 further rotates from a state shown in FIG. 4D, the sheet 106 moves along a lower surface of the peeling plate 111 in a rightward direction of the drawing. The heating roller 101 is thereby prevented from continually rotating while the sheet 106 remains affixed to and wrapped around the heating roller 101.

When the nozzle 113*a* stops squirting compressed air, the elastically-deformed peeling plate 111 returns to the position shown in FIG. 4A. Since the front edge of the sheet 106 has already passed by the front edge 116 of the peeling plate 111 in this stage, the sheet 106 advances in a rightward direction of the drawing and at a position beneath the peeling plate 111. Thus, the effect of the peeling plate 111 peeling the sheet 106 off from the heating roller 101 is achieved.

In addition to the working-effect, an effect of peeling of the sheet 106 being promoted by the compressed air flow squirted from the nozzle 113*a* and an effect of prevention of affixing of the sheet 106 to the peeling plate 111 are also achieved. Specifically, the air flows from the nozzle 113*a* toward the front edge 116 along a back surface of the peeling plate 111; hence, an effect of the sheet 106 peeled off from the heating roller 101 being peeled further off from the heating roller 101; namely, an effect of peeling of the sheet 106 from the heating roller 101 being further promoted, is achieved. Moreover, the air flow from the nozzle 113*a* flowing toward the front edge 116 enters between the sheet 106 and the peeling plate 111, thereby preventing affixing of the sheet 106 to the peeling plate 111.

During operation, the peeling plate 111 contacts the heating roller 101 in a period of 40 to 100 msec. Since the contact time is limited, infliction of damage on the surface of the heating roller 101, which would otherwise be caused by contact of the peeling plate 111, is prevented.

(Modifications)

The peeling plate 111 can also be split into a plurality of pieces. The peeling plate can also assume any of shapes, such as those shown in FIGS. 5A to 5D. The direction of the nozzles 113*a* to 113*d* is not limited to the illustrated direction. The requirement is that the nozzles be adjusted to, in agreement with a working mode of the invention, a direction in which a sheet is reliably peeled off from a heating roller most efficiently. Further, the number of nozzles is not limited to the number of the illustrated nozzles.

The peeling member is not limited to a plate member like the peeling plate 111 and can also be a line-shaped member such as an extended pawl. In this case, it is preferable to achieve a configuration in which a plurality of peeling members are positioned and in which a sheet is peeled off from a rotating body at a plurality of positions. In the case in order to efficiently receive wind pressure of a compressed gas, it is preferable to provide each of the peeling members with a surface which undergoes wind pressure.

In order to efficiently deform the peeling plate 111 by means of wind pressure of the compressed air, a scale-like member is provided on the surface A of the peeling plate 111, to thus realize a configuration that does not hinder movement of the sheet traveling from a left direction of the drawing and that is susceptible to wind pressure of the compressed air squirted from the nozzle 113*a*.

(2) Second Embodiment (Configuration)

Figure 6:
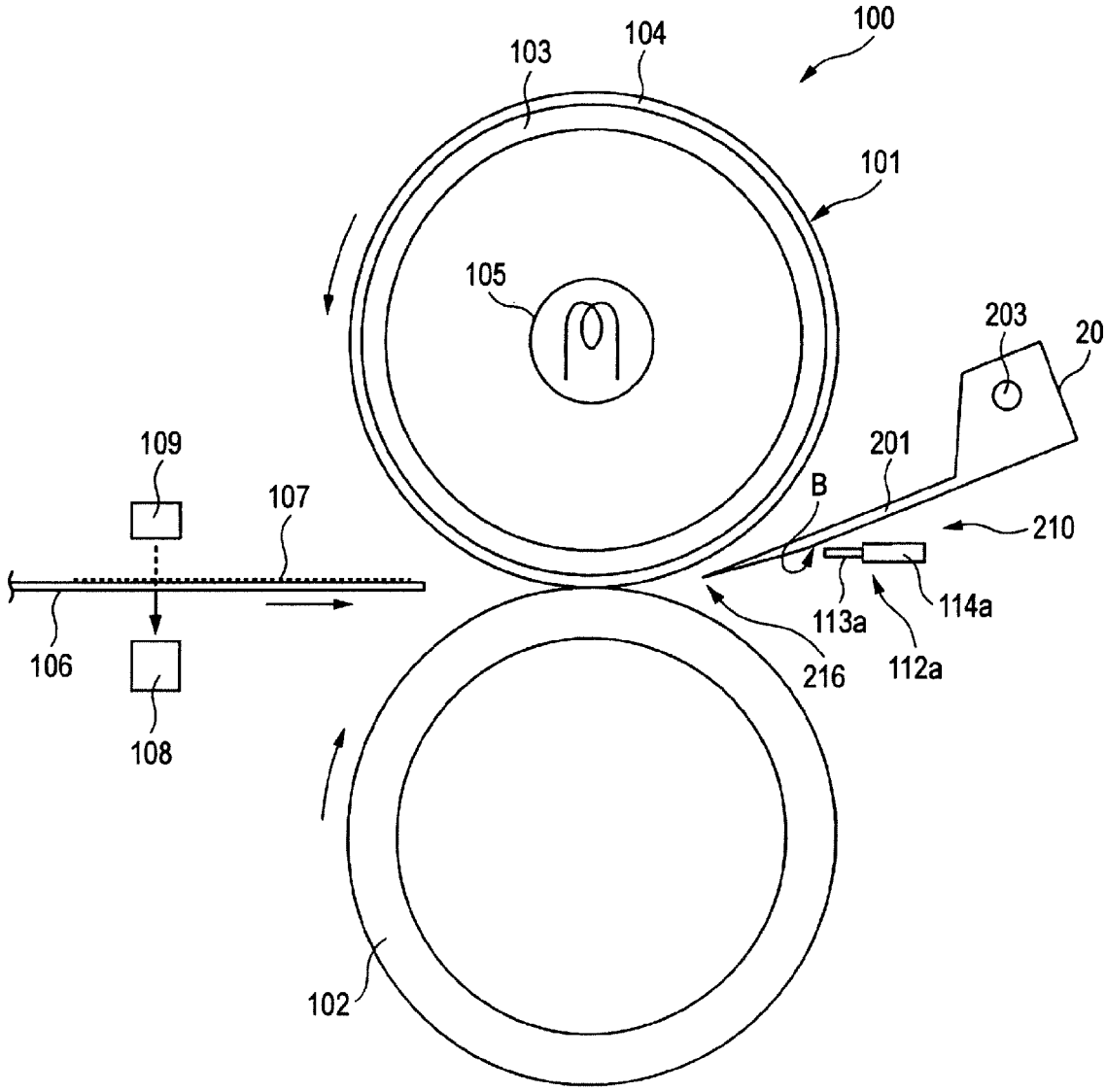
FIG. 6 is a conceptual diagram showing a fixing unit according to an exemplary embodiment of the invention.

There is hereunder described a configuration in connection with the configuration shown in FIG. 1, wherein the peeling plate 111 contacts the heating roller by the action of the spring during squirting of compressed air and recedes from the heating roller during the period of a non-squirt of compressed air. FIG. 6 is a conceptual diagram showing a fixing unit utilizing an exemplary embodiment of the present invention. FIG. 6 shows a peeling device 210 differing from its counterpart shown in FIG. 1 in terms of the structure of the peeling plate. In FIG. 6, the reference numerals that are the same as those shown in FIG. 1 designate the same elements described in connection with FIG. 1. Further, a control system of the second embodiment is structurally identical with that shown in FIG. 2.

The peeling device 210 shown in FIG. 6 has a peeling plate 201. The peeling plate 201 is a resin or metal plate.

Figure 7:
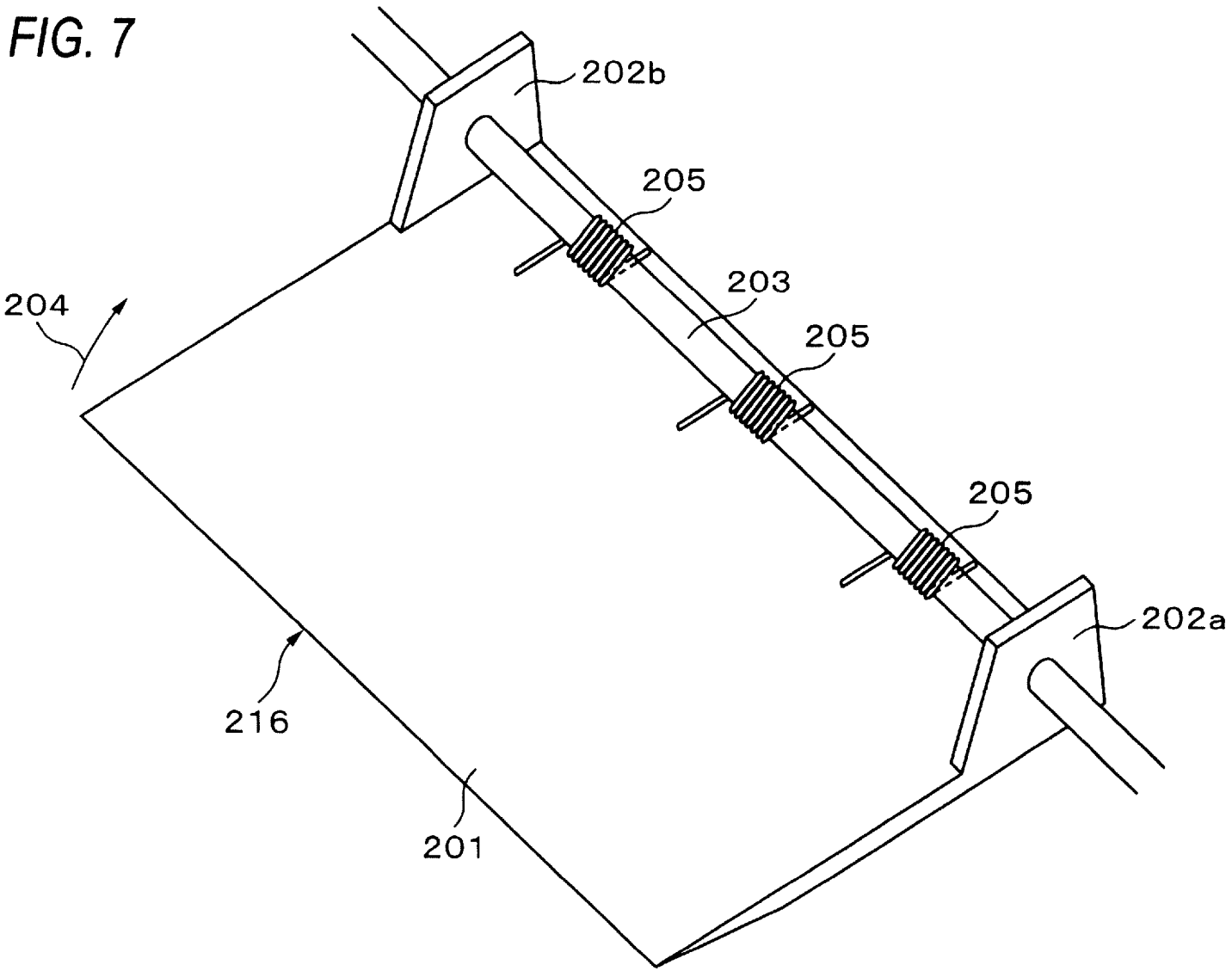
FIG. 7 is a perspective view showing a structure for supporting a peeling plate according to an exemplary embodiment of the invention.

FIG. 7 is a perspective view showing the g peeling plate 201 shown in FIG. 6 and a supporting structure therefor. The peeling plate 201 has flanges 202*a* and 202*b* that stand upright on a surface of the peeling plate. A shaft member 203 penetrates through the flanges 202*a* and 202*b* in a relatively-rotatable manner. Both ends of the shaft member 203 are fixed to a housing of an apparatus omitted from the drawings. Torsion coil springs 205 are wrapped around a periphery of the shaft member 203. One end of each of the torsion coil springs 205 is fastened to the shaft member 203, and the other end of the same remains in contact with an upper surface of the peeling plate 201.

Force is exerted on the front edge 216 of the peeling plate 201 (corresponding to reference numeral 116 shown in FIG. 1) in a direction designated by arrow 204 shown in FIG. 7. When the force is greater than repulsive force of the torsion coil springs 205, the front edge 216 of the peeling plate 201 rotates around the shaft member 203, while taking the shaft member as an axis, in the direction of arrow 204. When the force is eliminated, the front edge 216 of the peeling plate 201 returns to its original position by dint of repulsive force of the coil springs 205. A configuration of a returning unit for returning the peeling member to its original state before movement is constructed from the foregoing structure.

(Example of Operation)

When the nozzle 113*a* (and the unillustrated nozzles 113*b* to 113*d*) squirts compressed air in the leftward direction of the drawing in the state shown in FIG. 6, a surface B undergoes wind pressure. By means of the wind pressure, the front edge 216 moves upwardly while taking the shaft member 203 as an axis, to thus contact the heating roller 101. When squirts of the compressed air are stopped, the front edge 216 is brought out of contact with the heating roller 101 by dint of repulsive force of the torsion coil springs 205 shown in FIG. 7, to thus return to its original position. A positional relationship between the peeling plate 201 and the sheet 106 achieved as a result of operation is the same as that achieved in the case shown in FIG. 4. The action of the compressed air squirted from the nozzle 113*a* is also the same as that achieved in the first embodiment.

(3) Third Embodiment

Figure 8:
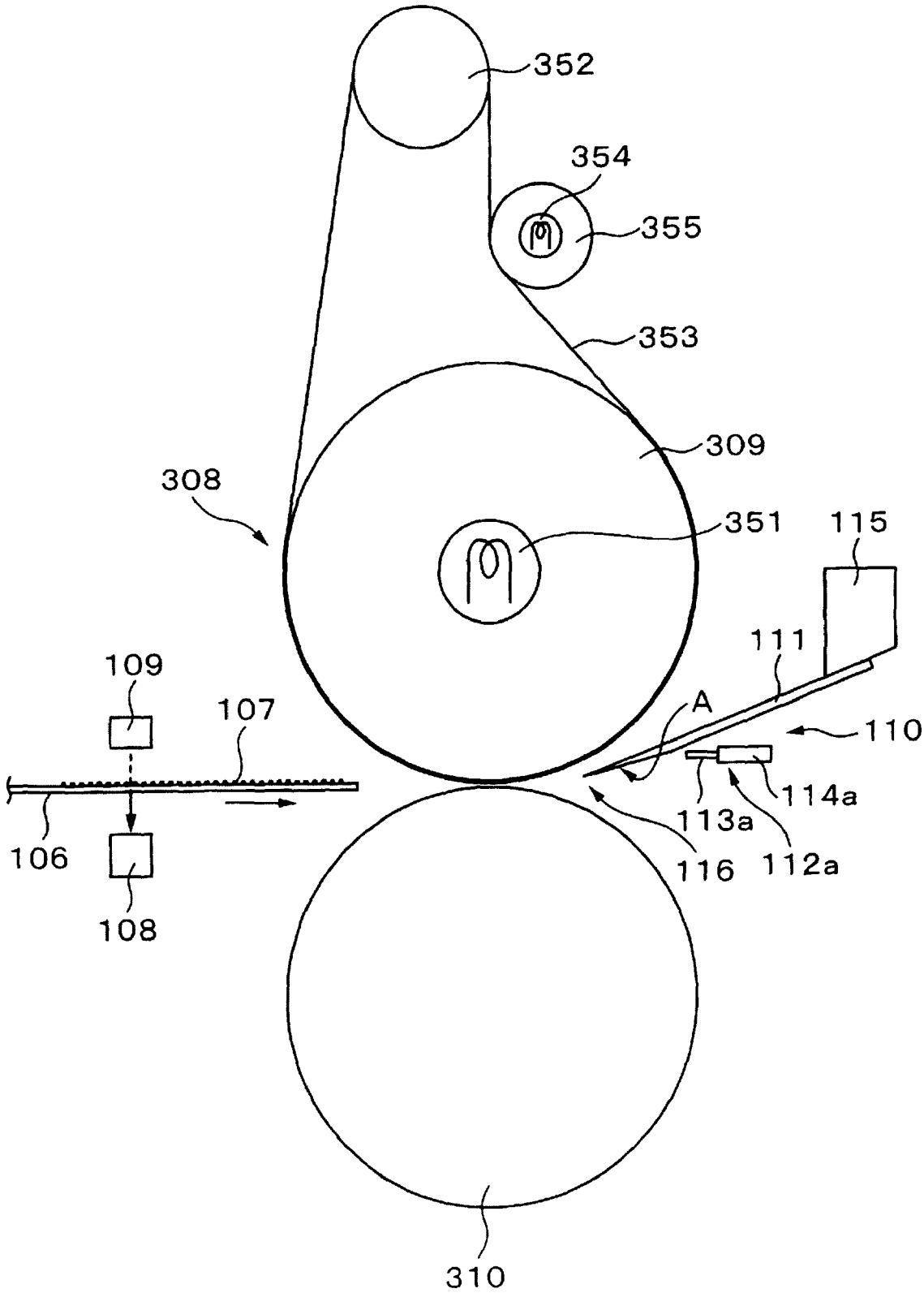
FIG. 8 is a conceptual diagram showing a fixing unit according to an exemplary embodiment.

FIG. 8 is a conceptual diagram showing a fixing unit utilizing a third embodiment of the present invention. FIG. 8 shows a fixing unit 308. The fixing unit 308 has a fixing roller 309 and a pressure roller 310. The fixing roller 309 has a heater 351. The fixing roller 309 is rotated by means of an unillustrated drive mechanism. A fixing belt 353, which is an embodiment of a rotating body, is passed between the fixing roller 309 and the tension roller 352. The tension roller 352 exerts tensile force to the fixing belt 353. A heating roller 355 having a built-in heater 354 remains in contact with the fixing belt 353. The pressure roller 310 is disposed opposite the fixing roller 309.

The peeling device 110 similar to that shown in FIG. 1 is disposed on a sheet-output side of the fixing unit 308. Details of the peeling device 110 are the same as those described in connection with FIG. 1. The sheet detection sensor 108 for detecting the sheet 106 is disposed upstream of the fixing roller 309. The fixing unit is the same as that described in connection with the first embodiment with regard to another configuration and the control system of the peeling device 110. The operation of the peeling mechanism is also identical with that described in connection with the first embodiment. In the configuration shown in FIG. 8, the peeling device 210 shown in FIG. 6 can also be adopted.

(4) Fourth Embodiment (Image Forming Apparatus)

Figure 9:
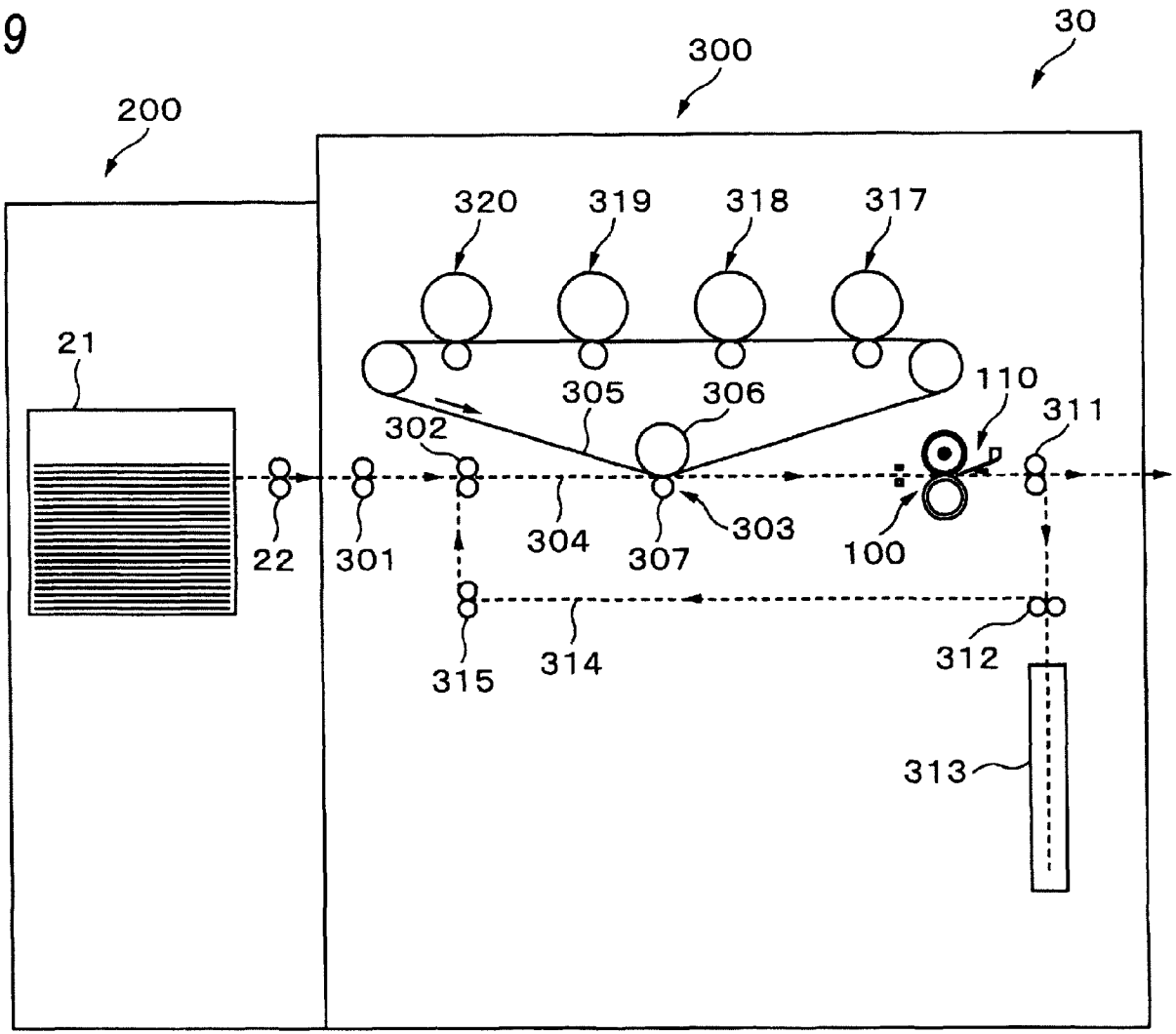
FIG. 9 is a conceptual diagram showing an image forming apparatus according to an exemplary embodiment of the invention.

An image forming apparatus having the fixing unit described in connection with the first embodiment is described. FIG. 9 is a conceptual diagram showing an embodiment of an image forming apparatus utilizing the present invention. FIG. 9 shows an image forming apparatus 30. The image forming apparatus 30 has a sheet feeding unit 20 that feeds a sheet; an image forming unit 300 that is an embodiment of an image forming unit; and the fixing unit 100 of the drawing.

(Sheet Feeding Unit)

The sheet feeding unit 20 has a storage device 21 storing a plurality of sheets; a delivery mechanism that delivers a sheet from the storage device 21 in a rightward direction of the drawing and that is omitted from the drawings; and a conveyance roller 22 that conveys the sheet delivered form the delivery mechanism in the rightward direction.

(Image Forming Unit)]

An image forming unit 300 has conveyance rollers 301 that convey a sheet delivered from the sheet feeding unit 20 into the image forming unit 300. Conveyance rollers 302 are disposed downstream of the conveyance rollers 301. The conveyance rollers 302 convey the sheet delivered from the conveyance rollers 301 or a sheet delivered from conveyance rollers 315 to be described later over a conveyance path 304 toward a secondary transfer section 303. The secondary transfer section 303 has a transfer roller 306 and an opposing roller 307. By nipping a transfer belt 305 and the sheet between the transfer roller 306 and the opposing roller 307, the secondary transfer section 303 transfers the toner image on the transfer belt 305 onto the sheet.

The fixing unit 100 is disposed downstream of the secondary transfer section 303. The fixing unit 100 has the configuration and functions described in connection with FIGS. 1 to 4.

The conveyance rollers 311 are disposed downstream of the fixing unit 100. The conveyance rollers 311 deliver the sheet delivered from the fixing unit 100 to the outside of the image forming unit or to conveyance rollers 312. The conveyance rollers 312 delivers the sheet delivered from the conveyance rollers 311 toward an inverter 313 and delivers the sheet output from the inverter 313 to the conveyance path 314. The conveyance rollers 315 for delivering the sheet conveyed in a leftward direction of the drawing to the conveyance rollers 302 is placed in the conveyance path 314. The conveyance path 314 is a conveyance path for turning the sheet inside out.

The image forming unit 300 has primary transfer units 317, 318, 319, and 320. Each of the primary transfer units has a photosensitive drum, a cleaner, an electrifier, an exposure unit, a development unit, and a transfer roller. The primary transfer units 317, 318, 319, and 320 generate Y (yellow), M (magenta), C (cyan), and K (black) toner images and transfer the thus-formed images on the rotating transfer belt 305. The YMCK toner images are thereby superimposed one on top of the other, whereupon a color toner image is produced on the transfer belt 305.

(Example of Operation)

An example of an operation for forming an image on the sheet housed in the storage device 21 is hereunder described. First, the sheet housed in the storage device 21 is conveyed in a rightward direction of the drawing by the conveyance rollers 22 and then delivered from the sheet feeding unit 200 to the image forming unit 300. The sheet taken into the image forming unit 300 is conveyed in the rightward direction of the drawing over the conveyance path 304, to thus be delivered to the secondary transfer section 303.

The respective YMCK toner images are superimposed, at the timing, one on top of the other on the transfer belt 305 by actions of the primary transfer units 317 to 320, whereby a color toner image is produced. The color toner image on the transfer belt 305 is transferred to the sheet in the secondary transfer section 303. The fixing unit 100 fixes the color toner image on the sheet to the sheet. At this time, peeling of the sheet from the heating roller is promoted by the principle descried in connection with FIG. 4. The sheet subjected to image fixing processing is output to the outside of the apparatus by the actions of the conveyance rollers 311 (or delivered toward inverter 313).

When an elaborate image is produced at high speed, the amount of toner to be used must be increased, and rotation of the heating roller (or the fixing belt) in the fixing unit must be made faster. As a consequence, the adhesion of the heating roller or the fixing belt to the sheet becomes high, and affixing of the sheet to the heating roller or the fixing belt becomes more obvious. Since the sheet is forcefully peeled off from the heating roller or the fixing belt by adoption of the configuration shown in FIG. 1, 6, or 8. Hence, even when affixing of the sheet to the heating roller or the fixing belt becomes evident, occurrence of a problem, such as sheet jamming or deformation of a sheet, attributable to affixing of a sheet can be prevented.

(5) Fifth Embodiment

In the state shown in FIG. 4B, the front edge 116 of the peeling plate 111 contacts the rotating heating roller 101. However, there is also possible a case where the sheet 106 is peeled off from the rotating heating roller 101 by the peeling plate 111 in a state where the front edge 116 of the peeling plate 111 approaches the surface of the heating roller 101 by air pressure of the compressed air but remains out of contact with the heating roller.

For instance, when the rigidity of the sheet 106 is high and when the front edge of the sheet 106 achieved in the direction of conveyance is slightly levitated (spaced away) from the heating roller 101 after passed through a nip area between the heating roller 101 and the opposing roller 102, the front edge 116 of the peeling plate 111 may also be out of contact with the surface of the rotating heating roller 101 in a state where the air pressure of the compressed air acts on the sheet.

Even in such a case, an eccentricity of the heating roller (a deviation of a distance between the periphery of the heating roller 101 and the center of rotation) and runout of the shaft may increase through repeated operation for reasons of deterioration, abrasion, and the like, of various members. In such a case, the front edge 116 may intermittently (an intermittent manner) contact the rotating heating roller when the nozzle 112*a* squirts a compressed gas, or the front edge 116 may contact the rotating heating roller 101 at all times when the nozzle 112*a* squirts a compressed gas.

Even when such a situation has actually developed, a time during which the peeling plate 111 contacts the heating roller 101 can be limited by utilization of the present invention. Hence, infliction of damage to the surface of the heating roller 101, which would otherwise be caused by a contact of the peeling plate 111 with the heating roller 101, can be prevented.

From the beginning of operation, the front edge 116 may also intermittently (or an intermittent manner) contact the rotating heating roller 101 at the time of squirting of a compressed gas from the nozzle 112*a* for reasons of an eccentricity of the heating roller 101, rattling or deformation of a structure for supporting the shaft of the heating roller 101, the deflection of the heating roller 101 itself, and the like. Even in such a case, even when such a possibility has come to true, the time during which the peeling plate 111 contacts the heating roller 101 can be limited by utilization of the present invention; hence, infliction of damage to the surface of the heating roller 101, which would otherwise be caused by contact of the peeling plate 111 with the heating roller 101, can be prevented.

(Application to Another Device)

In the above exemplification, embodiments of the present invention have been described by means of taking the fixing unit as an embodiment. However, a peeling device of the present invention can also be applied to a device other than the fixing unit. For instance, a glossing device to be disposed downstream of the fixing unit has been known. The glossing device performs operation for heating an image fixed on a sheet again and cooling the image while pressing a glossing surface with assured flatness against an image-produced surface of the sheet, to thus enhance flatness of an image surface, whereby there is performed processing for enhancing the feeling of gloss. Even in such a device, the sheet is brought into contact with a rotating body (e.g., a belt member), and hence peeling of the sheet from the rotating body is required. The peeling mechanism shown in FIG. 1 or 6 can be adopted for a section where the sheet is peeled off from the rotating body.

A peeling device of the present invention can be used for peeling off a document from a blanket in offset printing.

An embodiment of the invention can be utilized for a peeling device, a fixing unit, and an image forming apparatus.

What is claimed is:

1. A peeling device comprising:

a rotating body that conveys a recording material;

a peeling member capable of changing from a first state in which the peeling member does not contact the rotating body to a second state in which the peeling member is closer to the rotating body than peeling member in the first state is, the peeling member in the second state peeling off the recording material from the rotating body; and a gas spraying unit that sprays a gas to the peeling member to bring the peeling member from the first state to the second state.

2. The peeling device according to claim 1, wherein the second state is a state in which the peeling member contacts the rotating body.

3. The peeling device according to claim 1, wherein the gas sprayed unit spays the gas so that the gas flows between the recording material and the peeling member.

4. The peeling device according to claim 1, wherein the gas is a compressed gas.

5. The peeling device according to claim 1, wherein the peeling member comprises a material that brings the peeling member from the second state to the first state when the gas spraying unit stops spraying the gas.

6. The peeling device according to claim 1, further comprising a return unit that brings the peeling member from the second state to the first state when the gas spraying unit stops spraying the gas.

7. The peeling device according to claim 1, wherein spraying of the gas starts before a leading edge of the recording material approaches an edge of the peeling member and stops after the leading edge of the recording material passes by the edge of the peeling member.

8. A fixing unit comprising:

a peeling device according to claim 1; and a heating unit that heats the rotating body.

9. The peeling device according to claim 7, wherein spraying of the gas is a term ranging from 40 msec to 100 msec.

10. An image forming apparatus comprising:

an image forming unit that forms an image on a recording material; and a fixing unit according to claim 8 that fixes the image to the recording material.

* * * * *